10/20/87 XR 4,701,663

United States Patent [19]

Kawakatsu et al.

[11] Patent Number: 4,701,663

[45] Date of Patent: Oct. 20, 1987

[54] LAMP HAVING INTERFERENCE FILM

[75] Inventors: Akira Kawakatsu, Yokohama; Yooji Yuge, Chigasaki; Noriyuki Hayama, Yokohama; Tokuyoshi Saito; Umio Maeda, both of Ichihara, all of Japan

[73] Assignee: Kabushiki Kaisha Toshiba, Kawasaki, Japan

[21] Appl. No.: 791,110

[22] Filed: Oct. 24, 1985

[30] Foreign Application Priority Data

Oct. 24, 1984 [JP] Japan ..... 59-221942

[51] Int. Cl.[4] ..... H01K 1/26; H01K 1/32

[52] U.S. Cl. ..... 313/112; 313/580; 350/1.6; 350/166

[58] Field of Search ..... 313/112, 113, 578, 579, 313/580; 350/1.6, 164, 166; 362/293

[56] References Cited

U.S. PATENT DOCUMENTS 2,519,722 8/1950 Turner ..... 313/112 X
3,325,666 6/1967 Bird et al. ..... 313/112 X
4,331,901 5/1982 de Vrijer et al. ..... 313/112 X
4,588,923 5/1986 Hoegler et al. ..... 313/112 X

FOREIGN PATENT DOCUMENTS 3227096 2/1983 Fed. Rep. of Germany .
2128805 5/1984 United Kingdom .

*Primary Examiner*—David K. Moore
*Assistant Examiner*—K. Wieder
*Attorney, Agent, or Firm*—Cushman, Darby & Cushman

[57] ABSTRACT

A lamp includes a glass bulb sealing a filament therein. A light interference film is formed on a surface of the bulb. The film has at least five layers and is formed by alternately stacking a low-refractive index layer comprising silicon oxide and a high-refractive index layer having a refractive index higher than said low-refractive index layer. The low-refractive index layer contains, at least one additive selected from the group consisting of phosphorus and boron.

8 Claims, 2 Drawing Figures

LAMP HAVING INTERFERENCE FILM

BACKGROUND OF THE INVENTION

1. Field of the Invention

The present invention relates to a lamp for selectively and externally emitting light of a desired wavelength range using a light interference film.

2. Description of the Prior Art

In a recently proposed halogen lamp, an infrared ray reflecting film through which visible light passes is formed on the surface of the tubular bulb. Of the light emitted by the filament, infrared light is reflected from the reflecting film and returned to the filament. Thus, the returning infrared light heats the filament and the emitting efficacy is improved. At the same time, the amount of infrared light emitted outside the lamp is reduced.

Such an infrared ray reflecting film is formed with layers of a low-refractive index layer of silicon oxide ($SiO_2$) or the like and a high-refractive index layer of titanium oxide ($TiO_2$) or the like. The film can selectively transmit or reflect light of desired wavelength utilizing light interference, particularly by controlling the thickness of each layer. This type of film is called a light interference film.

In a conventional lamp of this type, during operation over a long period of time, the light interference film may cause cracking or peeling. This phenomenon is particularly notable in halogen lamps having a high operation temperature and incandescent lamps operated by repeating short lighting intervals.

In view of this problem, Japanese Patent Disclosure (Kokai) No. 57-124301 discloses a film formed by alternately stacking a low-refractive index layer of silicon oxide (silica) and a high-refractive index layer of aluminua ($Al_2O_3$), zirconium oxide ($ZrO_2$) and/or titanium oxide. Tin and/or zirconium is added to the silica low-refractive index layer.

When a light interference film of the type described in the above-mentioned Disclosure is applied to a halogen lamp having a bulb consisting of a hard glass such as quartz glass or borosilicate glass, cracking or peeling of the light interference film is observed upon frequent on/off operations or operation over a long period of time. A satisfactory performance cannot be obtained when this type of light interference film is used in such a lamp.

Japanese Patent Disclosure (Kokai) No. 57-161809 discloses a $TiO_2/SiO_2/TiO_2$ three-layered film for use in a reflector, a decorative color glass, a mirror or a filter. This Disclosure also discloses the use of phosphorus pentoxide in an amount of 0.5 to 3% by weight based on the weight of $SiO_2$. However, when this three-layered film is used in a lamp of the type described above, a satisfactory light interfering effect cannot be obtained. That is, the reflectance of infrared light is low. Further, this three-layered film cannot solve the problems mentioned above.

SUMMARY OF THE INVENTION

It is, therefore, an object of the present invention to provide a lamp haivng a light interference film which has high light-interference efficiency and infrared light reflecting property and does not crack or peeling upon frequent on/off operations or operation over a long period of time.

In order to achieve the above object of the present invention, there is provided a lamp comprising a glass bulb sealing a filament therein, and a light interference film formed on a surface of the bulb and having at least five layers, the interference film being formed by alternately stacking a low-refractive index layer comprising silicon oxide (silica) and a high-refractive index layer, the low-refractive index layer of silica containing at least one additive selected from the group consisting of phosphorus and boron.

DETAILED DESCRIPTION OF THE PREFERRED EMBODIMENTS

In an attempt to provide a solution to the problem described above, the present inventors studied on additives which can be added to silicon oxide (silica) in order to reduce the difference in thermal expansion coefficient between the conventional low- and high-refractive index layers in view of the facts that the volume shrinkage is considerable when an organic silicon compound is thermally decomposed and that the conventional low- and high-refractive index layers have considerably different coefficients of thermal expansion. As a result of such studies, the present inventors have found that a desired effect can be obtained by adding phosphorus and/or boron to silica, and the present invention has been made based on this finding.

The present invention will be described in detail with reference to the accompanying drawings.

Figure 1:
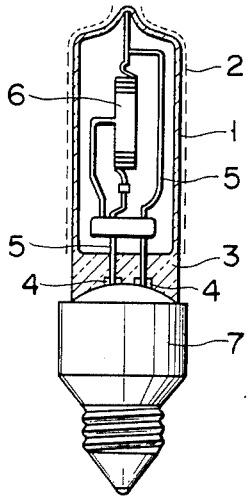
FIG. 1 is a sectional view showing a lamp according to the present invention.
Figure 2:
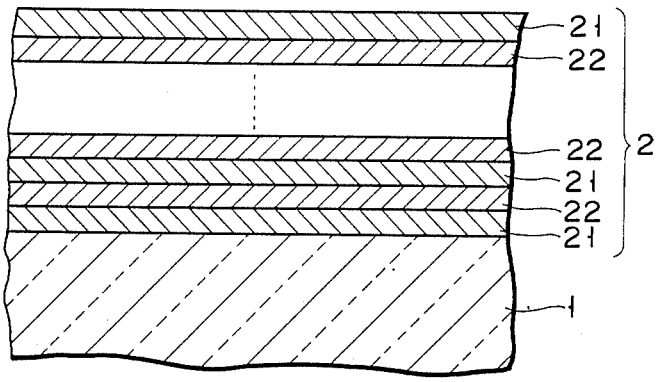
FIG. 2 is a sectional view of a light interference film formed in the lamp according to the present invention.

FIG. 1 shows a small halogen lamp according to the present invention. The lamp has a tubular bulb 1 of heat-resistant, transparent glass such as transparent quartz glass. An end 3 of the bulb 1 is sealed. Molybdenum lead foils 4*a* and 4*b* are buried in the sealed end 3 and are connected to internal leads 5*a* and 5*b*. A tungsten coil filament 6 is supported between the leads 5*a* and 5*b* at the center of the bulb 1. A base 7 is mounted at the sealed end 3. An inert gas such as argon gas and a halogen gas are filled in the bulb 1.

A visible light transmitting/infrared ray reflecting film 2 as a light interference film is formed on the outer surface of the bulb 1. The film 2 has at least 5 layers, e.g., 9 to 13 layers. A high-refractive index layer 21 and a low-refractive index layer 22 are alternately stacked on each other. The lowermost layer of the film 2 is the high-refractive index layer 21 and the uppermost layer of the film 2 is the high-refractive index layer. The layer 21 comprises at least one metal oxide material having a high refractive index such as titania, tantalum oxide, or zirconia. The layer 22 comprises silicon oxide and a predetermined amount of phosphorus and/or boron. The film 2 transmits visible light and reflects infrared light in accordance with light interference. When the number of layers in the film 5 is below 5, a satisfactory light interference effect cannot be obtained. That is, an infrared light reflection effect is impaired, and a high-quality lamp cannot be obtained.

The layers 21 and 22 normally have an optical thickness of 0.2 $\mu$m to 0.4 $\mu$m.

The amount of the additive, i.e., phosphorus and/or boron, in the layer 22 is about 3 to 20% by weight in terms of phosphorus pentoxide ($P_2O_5$) and/or boron trioxide ($B_2O_3$), respectively. That is, the amount of phosphorus is calculated on the basis of $P_2O_5$ and the amount of boron is calculated on the basis of $B_2O_3$. When the amount of the additive added is below about 3% by weight and when the film 2 has more than 5 layers, the film 2 cracks or peels upon repeated on/off operations or operation over a long period of time. On the other hand, when the amount of the additive is increased, the refractive index of the low-refractive index layers 22 increases and the number of layers for the film 2 must be increased to obtain a prescribed effect. When the amount of the additive exceeds 20% by weight, refractive index of silica is increased excessively (exceeds 1.500). Then, a light interference effect cannot be obtained, and the resultant film becomes non-uniform. The preferable amount of the additive is 5 to 10% by weight.

A method of forming the light interference film 2 will be described with reference to the case wherein high-refractive index layers consist of titania. First, titanium alkoxide, e.g., tetraisopropoxy titanium or tetramethoxy titanium is dissolved in an alcohol solvent, e.g., ethanol. A bulb 1 is immersed in the resultant solution. After the bulb 1 is pulled at a constant speed (e.g., 20 to 30 cm/min.), it is dried and baked at about 500° to 600° C. in air for about 10 minutes. Upon baking, the titanium alkoxide decomposes into titania to form a high-refractive index layer 21. Next, tetraalkoxysilane such as tetraethoxysilane or tetramethoxysilane is dissolved in an alcohol solvent, e.g., ethanol and allowed to react so as to prepare a tetraalkoxysilane condensed solution having a silicon concentration (in terms of silica concentration silica) of, e.g., 5.0% by weight. A phosphorus compound and/or a boron compound are added to the solution in amounts as described above. Specifically, phosphorus pentoxide is preferably used as the phosphorus compound, and boron trioxide is preferably used as the boron compound. The bulb having the high-refractive index layer 21 is immersed in the solution. After the bulb is pulled at a constant speed (e.g., 30 to 40 cm/min.), it is dried and baked at about 500° to 600° C. in air for about 10 minutes. A low-refractive index layer 22 consisting of silica and phosphorus and/or boron is formed on the layer 21. These processes are repeated to form the film 2.

The present invention will be described by way of its example.

EXAMPLE

A halogen lamp as shown in FIG. 1 was manufactured. Each high-refractive index film was formed in the following manner. That is, titanium tetraisopropoxytitanium was dissolved in ethanol in a concentration of 3%, and a bulb was immersed in the resultant solution. After the bulb was pulled at a constant speed of 25 cm/min. and dried, it was baked at about 500° to 600° C. for about 10 minutes. Each low-refractive index layer was formed in the following manner. A tetraethoxysilane was dissolved in ethanol and reacted to prepare a solution of condensed tetraethoxysilane containing 5% of silicon in terms of silica. Additives enumerated in Table below were dissolved in different portions of the resultant solution in various concentrations. After bulbs were immersed in the solutions, they were pulled at a constant speed of 35 cm/min., dried and baked at about 500° to 600° C. in air for about 10 minutes. The above two processes were repeated alternately to form the film 2. The total number of high- and low-refractive index layers of the film at which cracking or peeling occurred upon operation of the lamp was counted. The obtained results are also shown in Table below.

| Test | Additive | Additive Content (Wt %) | Film State | Refractive Index of Low-Refractive Index Layer |
|---|---|---|---|---|
| The Present Invention | Phosphorus Pentoxide | 3.0 | Cracking occurred upon forming 8 layers | 1.457 |
| | | 5.0 | Peeling occurred upper forming 12 layers | 1.465 |
| | | 8.0 | 13 or more layers could be formed | 1.468 |
| | | 10.0 | 13 or more layers could be formed | 1.478 |
| | | 15.0 | 13 or more layers could be formed | 1.490 |
| | | 20.0 | 13 or more layers could be formed | 1.499 |
| The Present Invention | Boron Trioxide | 3.0 | Peeling occurred upper forming 8 layers | 1.461 |
| | | 15.0 | 13 or more layers could be formed | 1.470 |
| | | | 13 or more layers could be formed | 1.495 |
| | | 20.0 | 13 or more layers could be formed | 1.500 |
| Comparative Example | Phosphorus Pentoxide | 0.5 | Peeling occurred upon forming 4 layers | 1.451 |
| | | 2.5 | Cracking occurred upon forming 4 layers | 1.456 |
| Comparative Example | Boron Trioxide | 2.5 | Cracking occurred upon forming 4 layers | 1.459 |
| Comparative Example | None Tin Oxide | — | Peeling occurred upon forming 4 layers | 1.450 |
| | | 5.0 | Cracking occurred upon forming 6 layers | — |

In the above Table, the amounts of additives are calculated based on the amounts of $P_2O_5$, $B_2O_3$ and $SiO_2$ in accordance with the following formula:

$$\text{Additive Amount (\% by weight)} = (P_2O_5 + B_2O_3) \div (SiO_2 + P_2O_5 + B_2O_3)$$

The number of layers referred to herein means the total number of layers 21 and 22.

It is seen from the above Table that the light interference film 2 of the present invention does not easily crack or peel. In particular, when the amount of phosphorus and/or boron added exceeds 3.0% by weight, the number of layers can be increased considerably without cracking or peeling, and a desired optical effect can be obtained with a sufficient number of layers. However, as the amount of phosphorus or boron is increased, the refractive index is increased and the number of layers must be increased. When the additive amount exceeds 20.0% by weight, the refractive index exceeds 1.500. This results in an impractical film from the viewpoints of optics and economy, and the film becomes non-uniform.

According to an experiment, a mixture of phosphorus and boron may be used, and in this case, a total amount of phosphorus and boron added must fall within a range of 3 to 20% by weight. It was also experimentally confirmed that a high-refractive index layer 21 can consist of tantalum oxide or zirconia, or a mixture of more than two of titania, tantalum oxide and zirconia. In this case, a total amount of phosphorus and/or boron to be added must also fall within a range of 3 to 20% by weight. The method of forming a light interference film as described above is not limited to the above method and can be a vacuum deposition method. In addition, the starting material of phosphorus or boron is not limited to those described above.

In a lamp according to the present invention, a light interference film consisting of alternately formed high- and low-refractive index layers is formed on at least one of the inner and outer surfaces of a glass bulb of the lamp. Each low-refractive index layer consists of silica to which phosphorus and/or boron is added. Therefore, even if the interference film consists of a number of layers, the film does not crack or peel.

What is claimed is:

1. A lamp comprising:

a glass bulb sealing a filament therein; and a light interference film formed on a surface of the bulb and having at least five layers, the film being formed by alternately stacking a low-refractive index layer comprising silicon oxide and a high-refractive index layer having a refractive index higher than said low-refractive index layer, said low-refractive index layer containing, at least one additive selected from the group consisting of phosphorus and boron.

2. A lamp according to claim 1, wherein a total amount of phosphorus in terms of phosphorus and boron in terms of boron trioxide is about 3 to 20% by weight.

3. A lamp according to claim 1, wherein each of the low-refractive index layers contains the additive in an amount of 5 to 10% by weight.

4. A lamp according to claim 1, wherein the additive is in the form of phosphorus pentoxide.

5. A lamp according to claim 1, wherein the additive is in the form of boron trioxide.

6. A lamp according to claim 1, wherein the additive is in the form of a mixture of phosphorus pentoxide and boron trioxide.

7. A lamp according to claim 1, wherein each of the high-refractive index layers comprises at least one member selected from the group consisting of titanium oxide, tantalum oxide and zirconium oxide.

8. A lamp according to claim 1, wherein the light interference film is formed on the outer surface of said bulb.

* * * * *